US006703979B2

(12) United States Patent
Sambles et al.

(10) Patent No.: US 6,703,979 B2
(45) Date of Patent: Mar. 9, 2004

(54) GRATING

(75) Inventors: John R Sambles, Exeter (GB); Christopher R Lawrence, Farnborough (GB)

(73) Assignee: QinetiQ Limited, Farnborough (GB)

( * ) Notice: Subject to any disclaimer, the term of this patent is extended or adjusted under 35 U.S.C. 154(b) by 0 days.

(21) Appl. No.: 10/220,855

(22) PCT Filed: Mar. 7, 2001

(86) PCT No.: PCT/GB01/00976

§ 371 (c)(1), (2), (4) Date: Sep. 6, 2002

(87) PCT Pub. No.: WO01/69718

PCT Pub. Date: Sep. 20, 2001

(65) Prior Publication Data

US 2003/0058188 A1 Mar. 27, 2003

(30) Foreign Application Priority Data

Mar. 11, 2000 (GB) ..... 0005788

(51) Int. Cl.[7] ..... H01Q 19/06
(52) U.S. Cl. ..... 343/754; 343/753; 343/909
(58) Field of Search ..... 343/754, 753, 343/755, 756, 757, 909, 787

(56) References Cited

U.S. PATENT DOCUMENTS

| | | | | |
|---|---|---|---|---|
| 2,607,009 A | | 8/1952 | Affel | 343/753 |
| 4,323,901 A | * | 4/1982 | De Wames et al. | 343/754 |
| 4,551,692 A | * | 11/1985 | Smith | 343/756 |
| 4,588,994 A | * | 5/1986 | Tang et al. | 343/754 |
| 5,268,702 A | | 12/1993 | Amano et al. | 343/846 |
| 5,450,092 A | | 9/1995 | Das | 343/787 |
| 5,729,239 A | | 3/1998 | Rao | 343/753 |

OTHER PUBLICATIONS

Diaz et al; "Novel Material with Narrow–Band Transparency Window in the Bulk"; Transactions of the IRE Professional Group On An tennas and Propagation, IEEE Inc. New York, vol. 48, No. 1, Jan. 2000, pp. 107–116, XP002138952.

Applied Physics Letters, Pendry et al; Oct. 30, 2000, vol. 77, No. 18, pp. 2789–2791.

Physical Review Letters, Porto et al; Oct. 4, 1999, vol. 83, Issue 14, pp. 2845–2848.

* cited by examiner

*Primary Examiner*—Hoang V. Nguyen
(74) *Attorney, Agent, or Firm*—Nixon & Vanderhye P.C.

(57) ABSTRACT

A grating comprising a plurality of substantially parallel members having a conducting surface of depth L, separated by a dielectric layer gap, and having of pitch $\lambda_g$ and where $L>16\lambda_g$. The members are preferably metallic or comprise metallic foil covered plastic. The gap may be filled wholly or partially with dielectric material including liquid crystal whose refractive index can be controlled by suitable application of voltage across the gap.

19 Claims, 5 Drawing Sheets

$R_{pp}$ and $R_{ps}$ at $\theta$=28.4°

$\varphi$=45°

$\varphi$=0°

$R_{ss}$ and $R_{sp}$ at $\theta$=28.4°

$\varphi$=45°

GRATING

This application is the US national phase of international application PCT/GB01/00976 filed Mar. 7, 2001, which designated the US.

This invention relates gratings and their application as wavelength filters, selective polarisors and as absorbers. It has particular but not exclusive application to microwaves.

Over the past few decades, interest has grown in enhanced transmission of electromagnetic waves through periodic metallic samples such as hole arrays and deep metallic arrays. Recently this has been attributed to Surface Plasmon Polaritons (SPP's) within the cavities of such samples causing the transmission of radiation though sample with cavity widths much smaller than the wavelength of radiation.

The study of the excitation of SPP's on metallic gratings has been carried out for over a century. However nearly all these investigations have been carried out with relatively shallow gratings which produce real diffractive orders.

The inventors however have determined that if the pitch of a grating is made shorter than half the incident wavelength and it is made very deep, then the side of the grooves come so close together that it is possible for the evanescent fields of excited SPP's on each side to interact across the narrow cavity. For certain depths the SPP's set up standing waves with in the cavity, causing large field enhancement within the grooves. The deep zero order grating provides a large number of such grooves in the form of a slat structure which will then give strong transmission of long wavelength radiation provided it is incident polarised with a component of the electric field orthogonal to the groove surfaces.

Accordingly the invention comprises a grating comprising a plurality of substantially parallel members having a conducting surface of depth L, separated by a dielectric layer gap, and having of pitch $\lambda_g$ and where $L>16\lambda_g$.

Preferably the members are metal slats.

The slats may alternatively comprise foil covered plastic. The gaps may be filled wholly or partially with dielectric material.

In a particularly advantageous embodiment the gap is filled wholly or partially with liquid crystal whose refractive index can be controlled by suitable application of voltage across the gap. This allows for a variable i.e. selective wavelength filter/polariser.

Preferably the gap is less than 1 mm.

The inventors have moreover ascertained a number of interesting effects and applications of this phenomena which will be clear from the description.

The invention will now be described and with reference to the following figure of which:

Figure 3A:
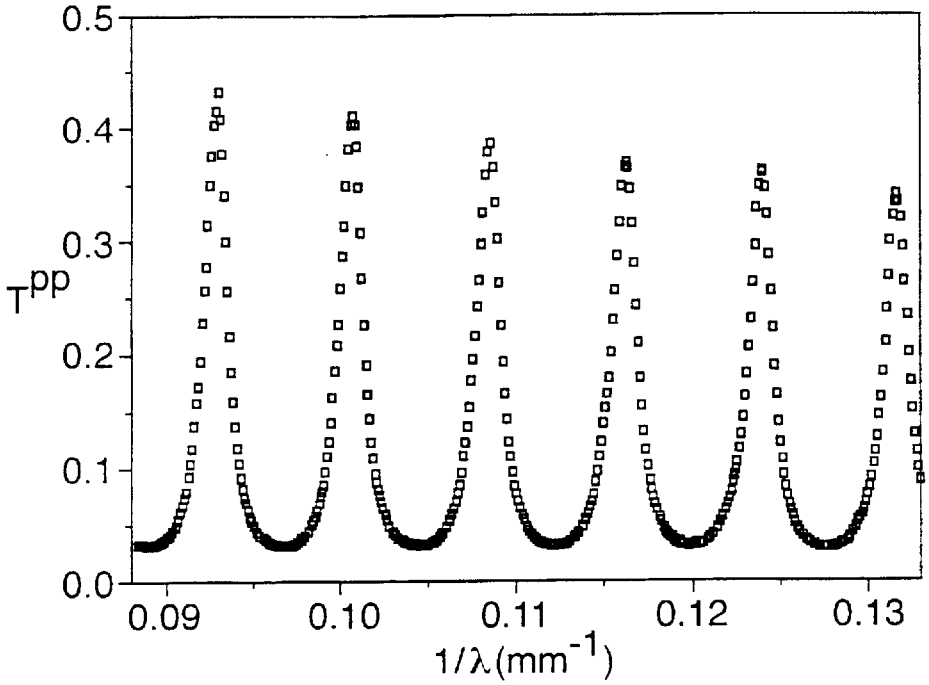

FIG. 3*a* shows the transmissivity of radiation through a particular grating according to the invention against $1/\lambda$.

Figure 3B:
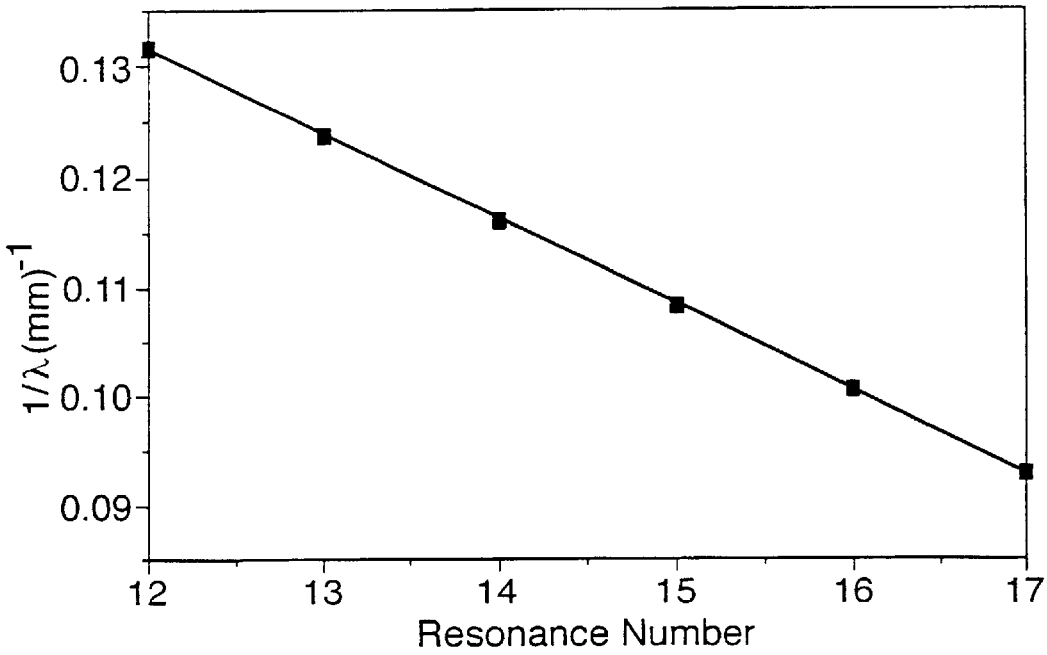

FIG. 3*b* shows the value of $1/\lambda$ against the resonance number for FIG. 3*a*.

Figure 4A:
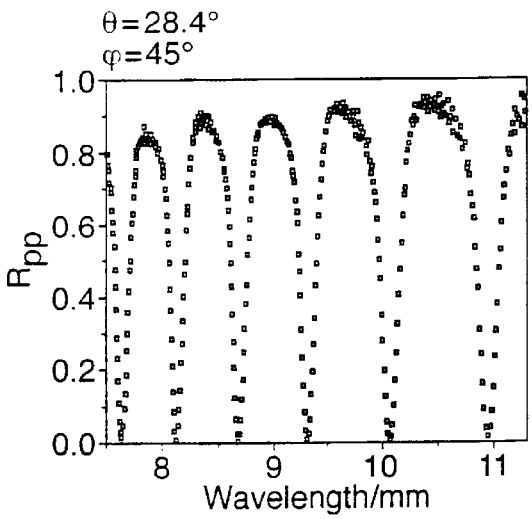
Figure 4A:
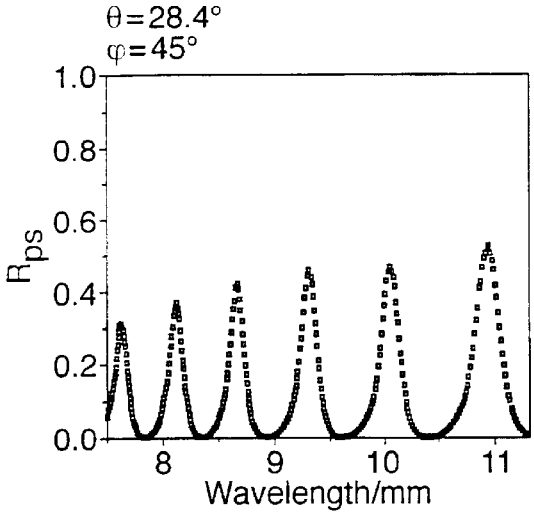
Figure 4A:
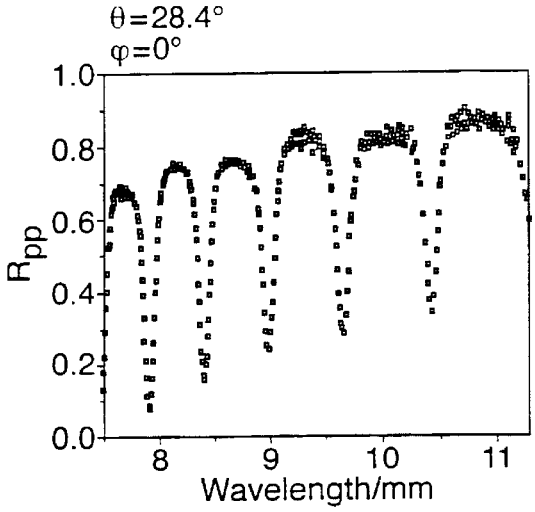
Figure 4B:
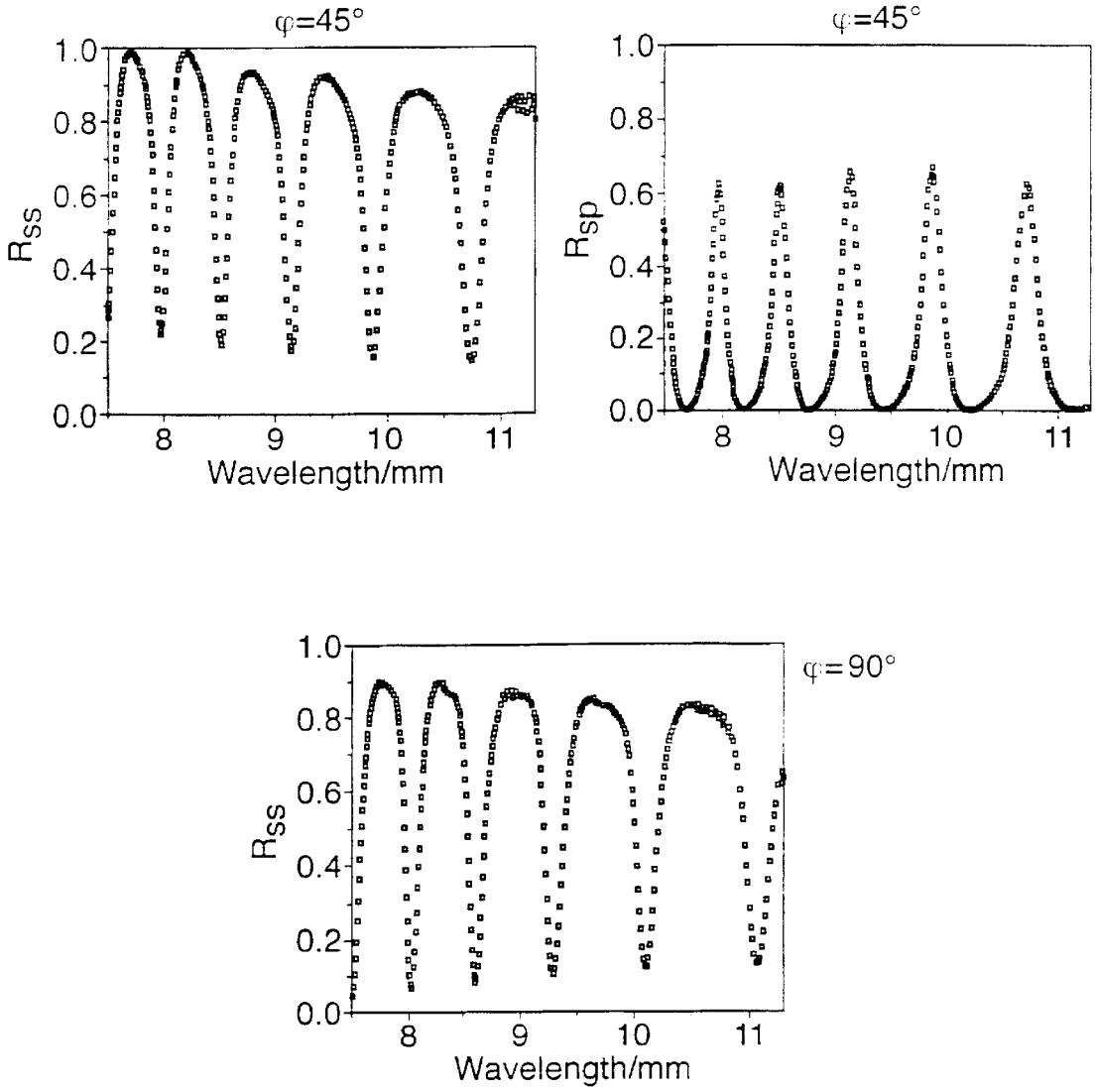

FIGS. 4*a* and *b* shows the reflectivities of a grating comprising aluminium slats of thickness 3 mm air gap 1 mm and grating depth of 65 mm.

Figure 5:
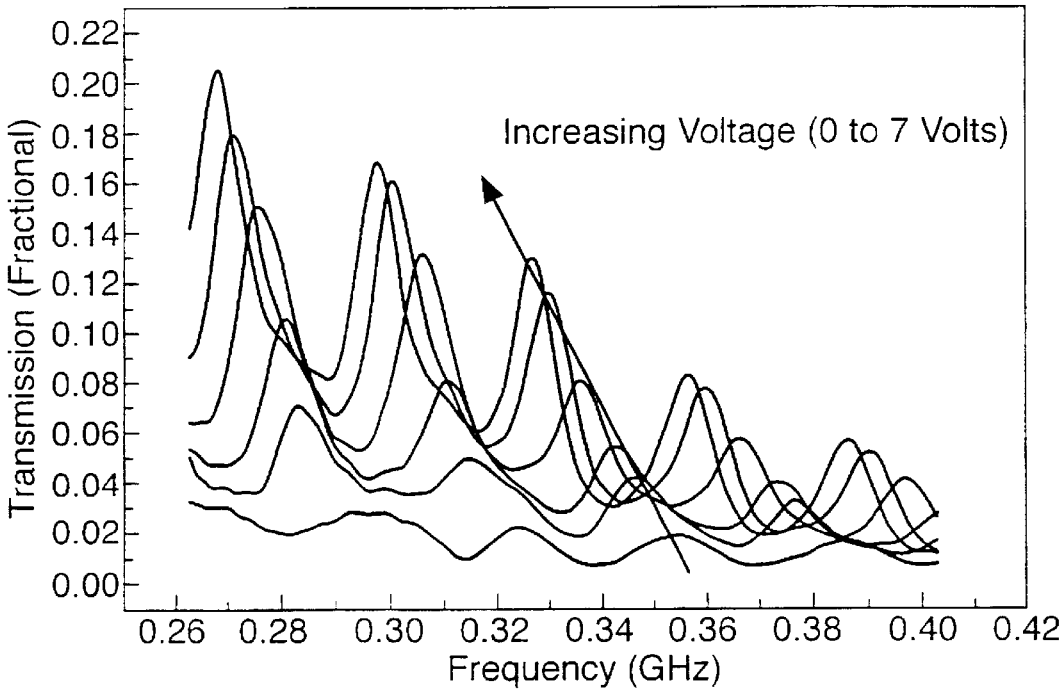

FIG. 5 shows the transmission of a grating comprising aluminium slats where the gaps between the slats has been filled with liquid crystal.

Figure 1:
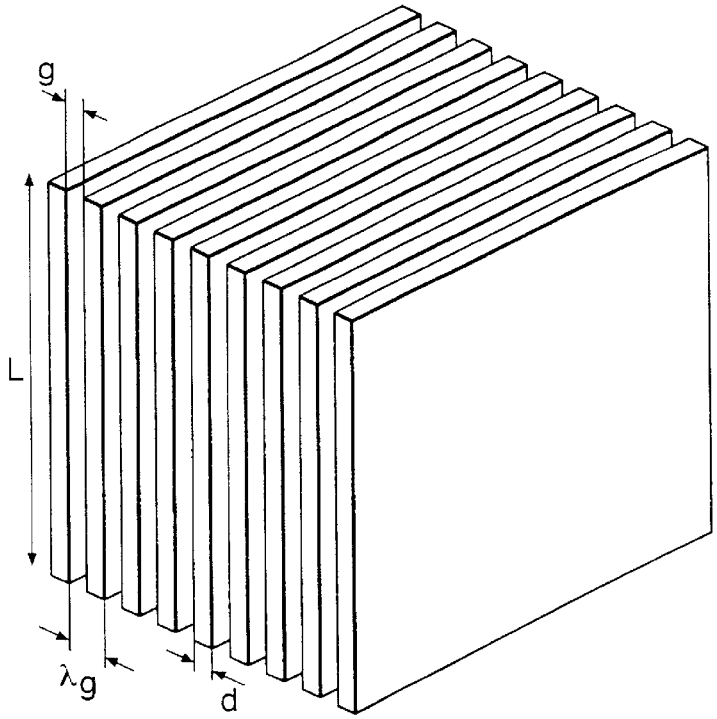
FIG. 1 shows a schematic view of a grating according to one embodiment of the invention.

FIG. 1 shows a view of a device comprising plurality of aluminium slats of dimension 3 mm thickness d by 64.7 mm by 600 mm depth L. These were stacked vertically by the assistance of a wooden frame (not shown) with spaces or gaps between the slats of thickness g=0.5 mm. A collimated beam of variable frequency radiation was incident on the sample in a direction perpendicular to the tops of the aluminium slats. The transmitted beam is collected by a spherical aluminium mirror and focussed to a detector. In the experiments only TM polarised radiation was used i.e. radiation whose electric vector lies along the grooves.

Figure 2:
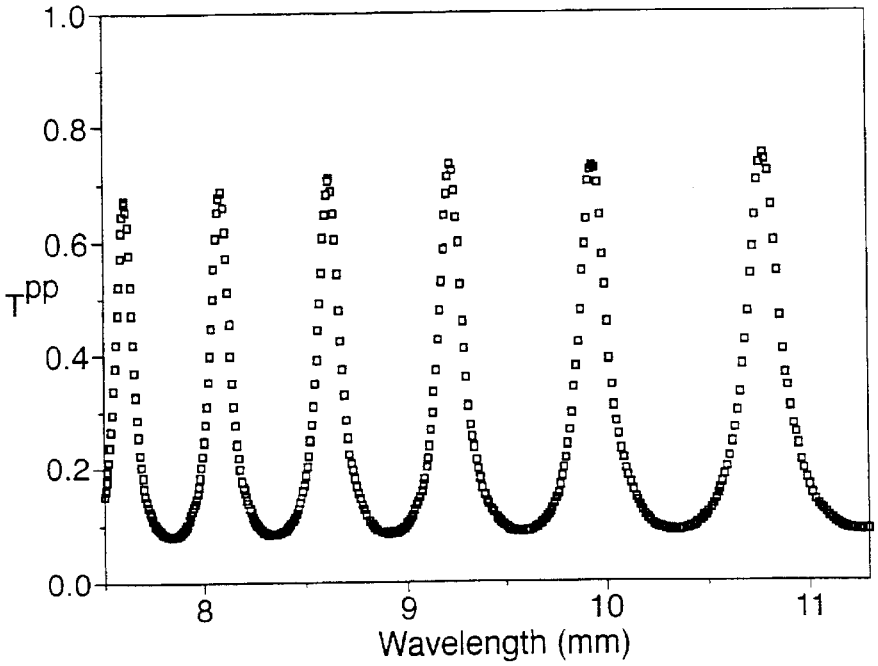
FIG. 2 shows the transmissivity of radiation through a particular grating according to the invention against its wavelength.

FIG. 2 shows the wavelength dependent transmissivity for the sample with air gaps of 500 microns. The Fabry-Perot nature of the strong resonant transmissivity is apparent and of course much higher than would normally be expected for a sample with cavity dimensions so much smaller than the wavelength.

FIG. 3*a* shows the transmissivity of the sample with air gap of 250 microns as a function of $1/\lambda$. FIG. 3*b* illustrates their regularity on this scale. These are the same resonances as those excited on the 500 micron sample and their positions in wavelength have changed very little. However due to the smaller air gap the reflectivity coefficient of the top surface has increased, decreasing the coupling strength of the resonance in the cavities. Thus since the positions of the resonances depend primarily on the length of L of the cavities and the coupling strength depends on the air gap, it is possible to specify and optimise both wavelengths transmitted and coupling strength independently. The resonances excited on this sample are of relatively high order, having 17 nodes (regions of zero electric field) within the cavities at the upper wavelengths and 12 nodes at the lower. This is also tunable by altering cavity depths; indeed in this frequency range it is possible to excite the first order resonance alone for a sample depth between 3.75 and 5.65 mm.

FIGS. 4*a* and *b* shows the reflectivities of a grating comprising aluminium slats of thickness 3 mm air gap 1 mm and grating depth of 65 mm. The reflectivities are denoted R and the initial and final subscripts denote the incident and deflected polarisations of radiation respectively. P-polarised is TM polarised, i.e. radiation whose electric vector has a component perpendicular to the grating grooves in the plane of incidence, whilst s-polarised radiation (TE) has its electric vector running along the grating grooves. $\phi$ is the azimuthal angle between the incident wave vector and the normal to the grating grooves in the plane of the vector. $\theta$ is the polar angle i.e. the angle between the incident wave vector and the normal to the average plane of the grating in the plane of incidence.

Generally the grating are transmitters for wavelengths $\lambda$ where $\lambda=2\ nL/N$ where N is an integer, n is the refractive index of the material between the slats and L is the depth of the plates.

In order to allow for variable wavelength filters the space between the slats can be filled with a material whose refractive index can be altered. The most practical way of doing this is by the use of liquid crystal material. This is particularly novel in that this has never been contemplated for microwave devices as the dimensions would be in the order of several millimeters and given the cost of LC's this would have been prohibitively expensive. Preferably the liquid crystals are polymer-dispersed liquid crystals which are relatively cheap robust and come in sheet form. Moreover the conductive surface of the slats can, by applying a voltage to them, be used to control the refractive index of the liquid crystal by acting as charged plates to produce an electric field across the gap.

FIG. 5 shows the transmission of a grating comprising aluminium slats where the gaps between the slats has been filled with liquid crystal as a function of frequency of electromagnetic radiation.

A very deep zero-order metallic gratings is built by stacking 55 strips of aluminium with mylar spacers at each end. The dimensions of the slats are length L=60.0 mm, width W=30.0 mm and thickness $D_{A1}$=1.0 mm. The thickness of the mylar-spaced gaps is $D_{LC}$=75.0 $\mu$m. The depth-to-pitch ratio of the gratings is about 30:1, they are zero order for wavelengths above about 2 mm. To facilitate alignment of the liquid crystal the aluminium slats are individually coated with a polyimide (AL 1254) film on both sides. They are then baked and uni-directionally rubbed along the short axis direction of the slats to provide homogeneous alignment of the liquid crystal molecules. The polyimide layers also act as ion barriers preventing ions entering the thin liquid crystal layers when a field is applied. These treated aluminium slats are then stacked as in the above array and capillary filled with a nematic liquid crystal (Merck-E7). Alternate slats are connected to an AC voltage source (1 kHz) thereby allowing the application of the same voltage across every gap. FIG. 5 shows the transmission of this grating as a function of frequency. As the voltage applied across the gaps is increased, the transmission through the grating increases at certain frequencies. This shows that voltage controlled wavelength selection at microwave frequencies by use of metallic slat gratings with the thin grooves between the metallic slats filled with liquid crystal is possible.

The pitch, $\lambda g$ as denoted in FIG. 1 must be less than half the wavelength of the radiation of interest if additional diffractive orders are to avoided (these reducing the overall transmission efficiency), whilst the gaps between metallic surfaces should be less than a quarter of the wavelength.

Preferably the cavity gaps are much less than the wavelength and can be as small as 1% of the wavelength or less.

It should be noted that the effect of this grating is on a wide spectrum of electromagnetic radiation varying in wavelength from about a micron to several meters (up to 100 m). it is also applicable to longer wavelengths although the grating dimensions would become prohibitively large.

In the example thus far described the grating comprises parallel slats i.e. small thin flat plates. These may also be aligned obliquely in relation to upper surface that they form in a parallelogram configuration, and or as parallel curved plates.

Slats are the most efficient configuration of the grating members. However other configurations may have advantages in certain applications. The members may form a 2-dimensional matrix comprising, for example, a matrix of square rod members. This would have advantages in where the desired effects are required on incident radiation which may have mixed or unknown polarisation direction.

Additionally the slats and rods can also be attached to an electrically conductive substrate (e.g. a metal sheet) producing similar effects in reflection.

If the spacer material is made slightly lossy, it is possible to couple microwaves into the structure and absorb them. The grating can therefore be used as a microwave absorber and it can be made wavelength specific. Additionally when such gratings are placed on an object and irradiated with microwaves, the object will heat up. The grating can therefore be used as heating means. Additionally appropriately designed gratings can be used to absorb other wavelengths and thus be used as radar absorbers.

What is claimed is:

1. A grating comprising a plurality of substantially parallel members having a conducting surface of depth L, separated by a dielectric layer gap, and having of pitch $\lambda_g$ and where $L>16\lambda_g$.

2. A grating as claimed in claim 1 wherein said members are slats.

3. A grating as claimed in claim 2 wherein said slats are non-perpendicular to the incident surface they form.

4. A grating as claimed in claim 1 wherein said members form a 2-dimensional array.

5. A grating as claimed in claim 4 wherein said members are square rods.

6. A grating as claimed in claim 1 wherein the members are metallic.

7. A grating as claimed in claim 1 wherein the members comprise metal foil covered plastic.

8. A grating as claimed in claim 1 wherein the gap is filled wholly or partially with dielectric material.

9. A grating as claimed in claim 8 wherein said gap is less than 1 mm.

10. A grating as claimed in claim 8 wherein said dielectric materials is liquid crystal whose refractive index can be controlled by suitable application of voltage across the gap.

11. A grating as claimed in claim 10 wherein said voltage is controlled by said slats themselves.

12. A grating as claimed in claim 1 additionally comprising an electrically conducting base.

13. A wavelength filter comprising a grating as claimed in claim 1.

14. A wavelength specific polariser comprising a grating as claimed in claim 1.

15. A wavelength specific absorber comprising a grating as claimed in claim 1.

16. A method of filtering electromagnetic radiation comprising passing it through a grating according to claim 1.

17. A method according to claim 16 wherein said radiation is microwave.

18. A method of wavelength specific polarisation of electromagnetic radiation by illuminating it onto a grating according to claim 1.

19. A method of absorbing radiation comprising by illuminating it onto a grating according to claim 1.

* * * * *